United States Patent [19]

Lowe

[11] Patent Number: 4,461,134

[45] Date of Patent: Jul. 24, 1984

[54] SHEET METAL BEAM

[76] Inventor: Colin F. Lowe, 5214 Sanford, Houston, Tex. 77035

[21] Appl. No.: 280,803

[22] Filed: Jul. 6, 1981

[51] Int. Cl.[3] ..... E04C 3/30

[52] U.S. Cl. ..... 52/732; 206/519; 29/155 R

[58] Field of Search ..... 52/732, 731, 729, 634; 29/155 R; 206/519, 520

[56] References Cited

U.S. PATENT DOCUMENTS

| | | | |
|---|---|---|---|
| 2,157,233 | 5/1939 | Geib, Jr. | 52/732 |
| 3,225,872 | 4/1965 | O'Brien . | |
| 3,349,535 | 10/1967 | Balinski | 52/729 X |
| 4,329,824 | 5/1982 | Lowe | 52/732 X |

FOREIGN PATENT DOCUMENTS

| | | | |
|---|---|---|---|
| 248782 | 1/1964 | Australia | 52/732 |
| 1534870 | 7/1967 | France . | |
| 1534871 | 9/1967 | France . | |
| 1479683 | 7/1977 | United Kingdom | 52/732 |
| 1590435 | 6/1981 | United Kingdom | 52/732 |

*Primary Examiner*—James L. Ridgill, Jr.
*Attorney, Agent, or Firm*—Jacox & Meckstroth

[57] ABSTRACT

An elongated beam is constructed from a sheet metal panel and has upper and lower flange sections integrally connected by a web section. The web section has upper and lower inclined web portions which project in opposite directions from a vertical intermediate web portion and cooperate to provide the beam with a generally Z-shaped cross-sectional configuration to facilitate stacking of a plurality of beams in interfitting nested relation. The upper and lower flange sections are stiffened by members which may be longitudinally extending sheet metal strips or longitudinally spaced stiffening elements, and the upper and lower flange sections and adjacent portions of the web section are formed slightly different in size to permit interfitting of mating overlapping end portions of two longitudinally aligned beams after one beam is inverted relative to the other.

16 Claims, 12 Drawing Figures

SHEET METAL BEAM

BACKGROUND OF THE INVENTION

In the construction of a metal building, it is common to use a frame which supports parallel spaced steel beams or purlins to which corrugated sheet metal roof panels are attached. The purlins have a Z-shaped cross-sectional configuration, for example, as illustrated in U.S. Pat. Nos. 2,871,997, 3,225,872, 3,290,845, 3,982,373 and 3,513,614 to provide for nesting of the purlins in a stack during storage and shipping. Similar Z-shaped beams are attached to the sides of the frames and are commonly referred to as wall girts for supporting the roll-formed sheet metal side wall panels. The most commonly used purlins are roll-formed from a relatively heavy gauge steel strip, such as fourteen gauge (0.074"), and have a height of approximately eight inches. Thus the flange portions of a purlin are integrally connected by the flat web portion, and all of the portions have a common uniform thickness which results in a weight of approximately 3.67 pounds per linear foot for an eight inch purlin.

While eight inch purlins are most commonly used because of its strength/weight ratio, purlins having a greater height, such as twelve inches, are also used in view of the fact that the stiffness of the purlin increases as the square of the height. However, as the flat web portion of a conventional purlin increases to provide the purlin with a greater height, the additional thickness of steel needed in the web portion adds little to the increased strength but substantially increases the weight of the purlin.

It has also been found desirable for the flange portions of a purlin to have a substantially flat outer surfaces to provide proper attachment of the purlins to the metal frame and of the roof panels to the purlins by suitable fasteners. While a one-piece conventional Z-shaped purlin may be efficiently manufactured by roll-forming, it does not provide maximum utilization of the strength of the steel and thus does not obtain the maximum strength/weight ratio. While there have been many other types of sheet metal beams either proposed or made, none of these beams have been found satisfactory for replacing the above described purlins commonly used in the construction of a metal building. For example, French Pat. Nos. 1,534,870 and 1,534,871 disclose roll-formed Z-shaped beams or purlins wherein the web section is inclined or has an inclined center portion so that the upper flange is located above the lower flange in order to minimize the roll-over moment of the purlin. However, these purlins do not permit the use of thinner gauge steel and do not reduce the metal required to form the purlins.

SUMMARY OF THE INVENTION

The present invention is directed to an improved sheet metal beam which provides increased utilization of the strength of the sheet metal in order to minimize the thickness or gauge of the sheet metal and to obtain a higher strength/weight ratio. While the beam of the invention is ideally suited for use as a purlin in the construction of a metal building, the beam of the invention may also be used in the construction of other building structures.

A beam constructed in accordance with the invention is also adapted to be efficiently manufactured at a significantly lower cost than the cost of manufacturing conventional metal beams or purlins, and further provides a significantly lower weight per linear foot of beam and a generally Z-shaped cross-sectional configuration so that the cost of handling and transporting the beam is significantly reduced. In general, the above features and advantages are provided by an elongated beam which is roll-formed from relatively thin sheet metal and includes a web section having upper and lower inclined web portions projecting laterally in opposite directions from a generally vertical intermediate web portion. The panel also forms upper and lower flange sections which project laterally in opposite directions from the web section with the upper flange section partially overlapping the lower flange section and providing the beam with a generally Z-shaped cross-sectional configuration to facilitate nesting of the beams in stacked relation. The beams also include means for stiffening the upper and lower flange sections relative to the web section either by longitudinally spaced attached stiffening elements or by longitudinal by extending strips conforming to portions of the web section and the upper and lower flange sections.

While a number of desirable features and advantages of a beam constructed in accordance with the invention are apparent from the drawings, other features and advantages of the invention will be apparent from the following description and claims in reference to the drawings.

DESCRIPTION OF THE PREFERRED EMBODIMENTS

Figure 1:
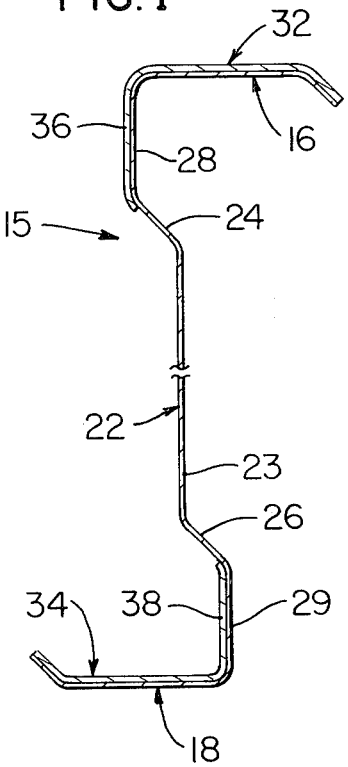
FIG. 1 is a vertical section through a sheet metal beam constructed in accordance with the invention.

The sheet metal purlin or beam 15 illustrated in FIG. 1 includes a sheet metal panel which is roll-formed to produce an upper flange section 16 and a lower flange section 18 which are integrally connected by a web section 22. The web section includes a flat intermediate portion 23 which is vertical or perpendicular to the flange sections 16 & 18. The web section 22 also includes and upper inclined portion 24 and a lower inclined portion 26 which project laterally in opposite directions from the vertical intermediate portion 23 and which are integrally connected to the corresponding flange sections by flat vertical web portions 28 and 29, respectively.

The beam or purlin 15 also includes a stiffening member in the form of an outer second flange section 32 which overlies the flange section 16, and an inner flange section 34 within the lower flange section 18. The outer flange portion 32 includes an integral web portion 36 which projects downwardly or vertically adjacent the web portion 28, and the inner flange section 34 includes a web portion 38 which projects vertically adjacent the web portion 29 of the sheet metal panel. The conforming upper flange sections 16 and 32 and the conforming lower flange sections 18 and 34 are rigidly secured together, preferably by longitudinal continuous seam welds.

In one construction of the beam 15 for replacing a conventional purlin having an eight inch height, the web section 22 are constructed of 20 gauge sheet metal (0.036"), and the stiffening flange sections 32 and 34 are formed of 22 guage (0.030"). In this construction, the strength of the Z-shaped beam or purlin 15 is the same as a standard purlin of 14 gauge (0.076"), but has a metal weight reduction of approximately 16 percent, which significantly reduces the cost of the purlin 15 relative to a standard or conventional purlin.

As apparent in FIG. 1, the lower flange sections 18 and 34 are slightly smaller than the upper flange sections 16 and 32 so that the end portions of two longitudinally aligned beams 15 may be connected in overlapping relation simply by rotating one of the beams 15 through 180° on a longitudinal axis. That is, the lower flange sections 18 and 34 of each beam 15 are adapted to interfit the flange section 16 and 32 of the longitudinally adjacent beam to provide for overlapping end portions of the beams and also to provide for close nesting of the beams in pairs when the beams are stacked for storage and transportation.

Figure 2:
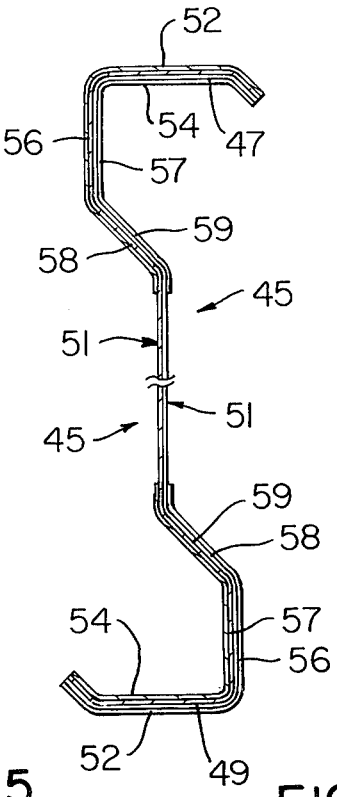
FIG. 2 is a vertical section of another beam similar to the beam shown in FIG. 1 and illustrating the interfitting relation of overlapping end portions of two of the beams.

FIG. 2 illustrates a purlin or beam 45 which has a construction similar to the beam 15 and which illustrates a vertical cross-section adjacent the overlapping end portions of two longitudinally aligned beams. In each of the beams 45, the sheet metal panel which forms the flange sections 47 and 49 and the integrally connected web section 51 is of the same gauge as the sheet metal stiffening or strip sections 52 and 54, for example, 20 gauge. In this embodiment, each of the stiffening sections 52 and 54 not only extends adjacent the corresponding flange section 47 and 49, but also extends along the vertical web portions 56 and 57 and the inclined web portions 58 and 59 of the web section 51. As a result, the beam 45 with a height over eight inches may replace standard eight inch purlin of 12 gauge sheet metal and provide a weight savings of approximately 13.5 percent.

Figure 3:
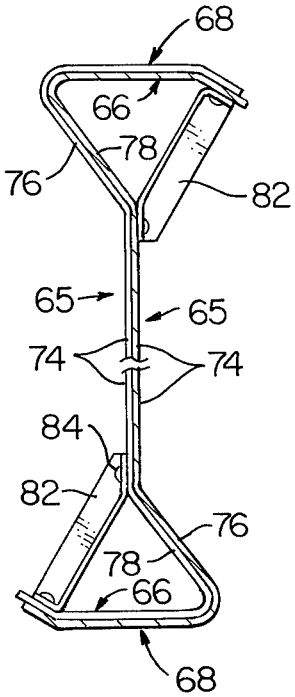
FIG. 3 is a vertical section of another sheet metal beam constructed in accordance with the invention and showing the interfitting relation of overlapping end portions of two of the beams.

FIG. 3 shows another vertical section adjacent the overlapping end portions of two purlins or beams 65 constructed in accordance with another embodiment of the invention. Each of the beam 65 includes parallel flange section 66 and 68 which are integrally connected by a web section 72 having an intermediate vertical web portion 74 and oppositely projecting inclined web portions 76 and 78. In the same manner as the beams 15 and 45, the flange section 66 and the inclined web portion 78 of each beam 65 is slightly smaller than the flange section 68 and inclined web portion 76 so that adjacent end portions of two longitudinally aligned beams 74 may be arranged interfitting relation as shown in FIG. 3 by rotating one of the beams 65 180° on a longitudinal axis.

Figure 4:
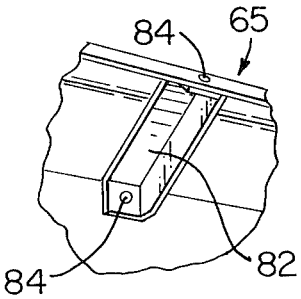
FIG. 4 is a fragmentary perspective view of a sheet metal brace member forming a stiffener in the beam shown in FIG. 3.

As also shown in FIGS. 3 and 4, each of the beams 65 has a series of longitudinally spaced stiffening or brace elements 82 which extend from the outer inclined edge portions of the flange sections of each beam to the intermediate vertical web portion 74 of each beam. As illustrated, each of the stiffening or brace elements 82 are formed of sheet metal and have a right angle cross-section and are secured to the flange and web sections by suitable fasteners such as rivets 84. Preferably, the brace elements 82 are attached to the flange and web sections after the beam 65 has been delivered to the site for the erection of a building so that the beams 65 may be closely nested during storage and shipping. The brace elements 82 are omitted from the larger flanges in the area of overlapping end portions.

Figure 5:
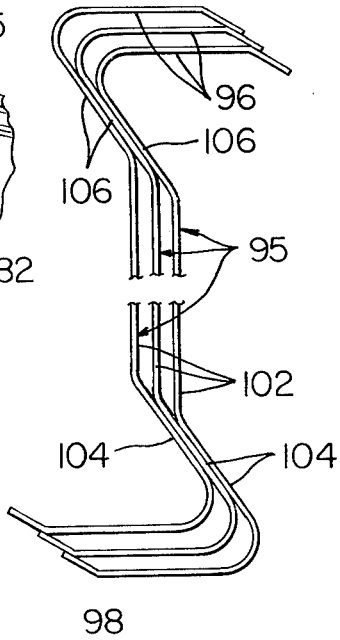
FIG. 5 is a view of the ends of three sheet metal beams similar to the beam shown in FIG. 3 and illustrating the beams in interfitting nested relation.

FIG. 5 illustrates a nested arrangement of three sheet metal purlins or beams 95 each of which is constructed substantially the same as the beam 65 and which includes flange sections 96 and 98 integrally connected by a web section having a vertical intermediate web portion 102 and oppositely projecting inclined web portions 104 and 106. The flange section 96 and web portion 106 are slightly smaller than the flange section 98 and web portion 104 to provide the interfitting relation of overlapping end portions of longitudinally adjacent beams when one of the beams 95 is rotated 180°.

Figure 6:
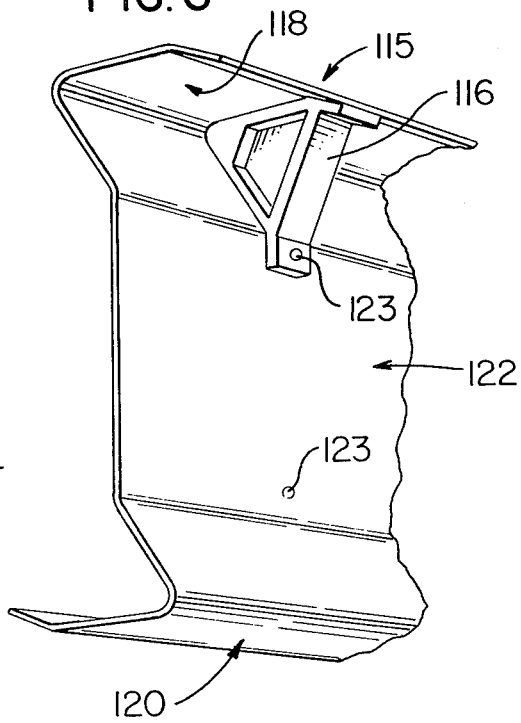
FIG. 6 is a fragmentary perspective view of a modified sheet metal beam constructed in accordance with the invention.

An end portion of a beam 115 is illustrated in FIG. 6, and this beam 115 is constructed substantially the same as the beam 95 with the exception that the beam 115 includes a series of longitudinally spaced stiffening or brace element 116. The brace elements 116 are attached to the corresponding flange sections 118 and 120 and to the web section 122 by suitable fasteners such as rivets or drive screws 123. Preferably, the brace elements 116 are formed as die castings or moldings and are attached to each beam 115 after the beam arrives at the building site so that the beams 115 may be nested during storage and shipping.

Figure 7:
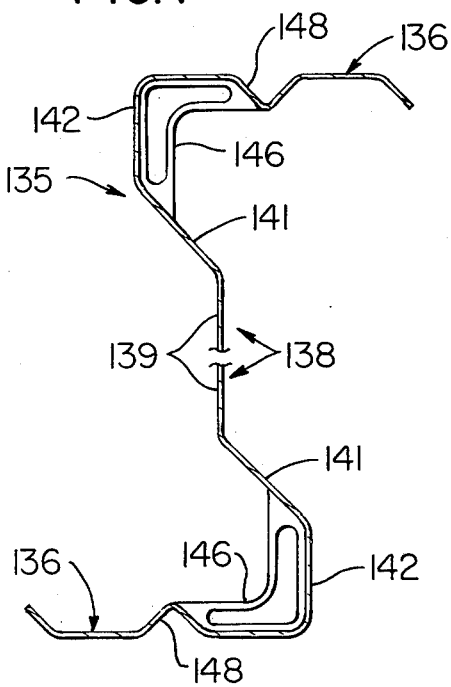
FIG. 7 is a vertical section through another sheet metal beam constructed in accordance with the invention.
Figure 8:
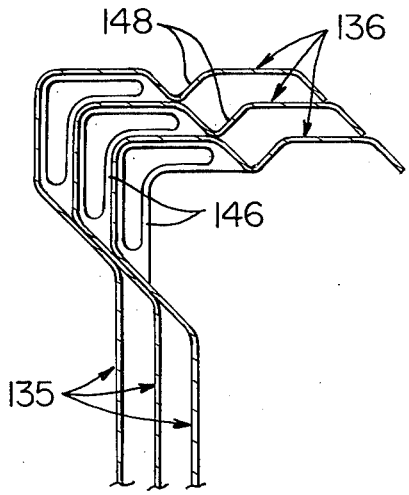
FIG. 8 illustrates the nesting of a plurality of the beams shown in FIG. 7.

FIGS. 7 and 8 show another purlin or beam 135 constructed in accordance with the invention. In this embodiment, the upper and lower flange sections 136 are a conforming match, slightly different in size and are integrally connected by a web section 138. The web section 138 is formed by a vertical web portion 139 which integrally connects oppositely projecting inclined web portions 141 and vertical web portions 142. The beam 135 also has a series of longitudinally spaced inside corner stiffening or brace elements 146 which may be formed as a die casting or as a molded plastics part. Each of the brace elements 146 are secured to the adjacent inclined web portion 141 and an inwardly projecting V-shaped rib 148 within the adjacent flange section 136 by flat head counter-sunk screws threaded into the elements. The stiffening elements 146 may be attached to the beam 135 as soon as the sheet metal panel is roll-formed since the brace elements 146 do not interfere with close nesting of a plurality of the beams 135 in a stacked relation, as shown in FIG. 8. In fact, as illustrated in FIG. 8, the stiffening or brace elements 146 also serve as bumpers or spacers when the beams 135 are stacked in nested relation so that each beam is protected from the weight of the beams stacked above the beam.

Figure 9:
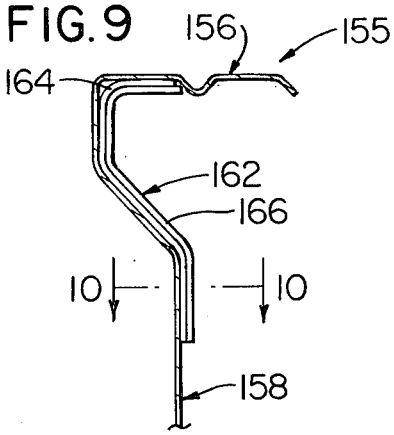
FIG. 9 is a fragmentary section of another sheet metal beam constructed in accordance with the invention.
Figure 10:
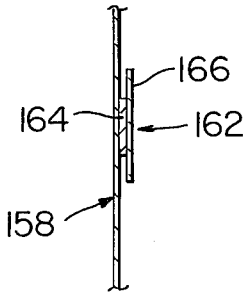
FIG. 10 is a fragmentary section taken generally on the line 10—10 of FIG. 9.

FIGS. 9 and 10 illustrate another Z-shaped purlin or beam 155 which is constructed similar to the beam 135 with respect to the cross-sectional configuration of the flange sections 156 and web section 158. In place of the corner stiffening or brace elements 146, the beam 155 includes a series of longitudinally spaced corner stiffening or brace elements 162 each of which has a T-shaped cross-sectional configuration (FIG. 10) formed by a narrow metal strip 164 and a wider metal strip 166 which conform to the shape of the flange sections 156 and web section 158. The longitudinally spaced inside corner stiffening elements 162 are preferably spot welded to the flange and web sections and provide for stacking a plurality of the beams 155 in relatively close nested relation, similar to the nested relation of the beams 135 illustrated in FIG. 8.

Figure 11:
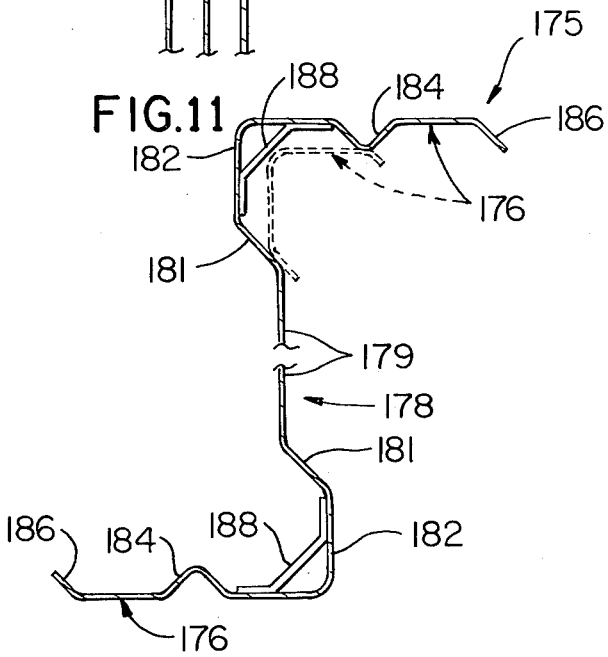
FIG. 11 is a vertical section of a modified beam constructed similar to the beam shown in FIG. 7.

A purlin or beam 175 is shown in FIG. 11 and includes a roll-formed sheet metal panel having a cross-sectional configuration substantially the same as the cross-sectional configuration of the beam 135. That is, the beam 175 includes conforming matching flange sections 175 integrally connected by a web section 178 formed by a vertical intermediate web portion 179, oppositely projecting inclined web portions 181 and vertical web portions 182. The flange sections 176 also have inwardly projecting V-shaped rib portions 184 and outer inclined edge portions 186. The beam 175 is provided with longitudinally spaced corner stiffening brackets or elements 188 which are preferably formed of sheet metal and are spot welded to the flange sections 176 and web portions 182 in the plant where the beam 175 is roll-formed. As illustrated by the dotted lines in FIG. 11, the corner brackets or stiffening elements 188 are located so that they do not interfere with relative close nesting of the beams 175 when the beams are stacked for storage and shipping.

Figure 12:
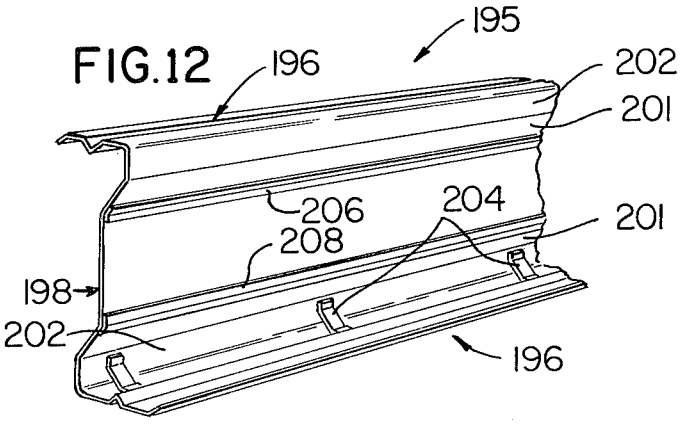
FIG. 12 is a fragmentary perspective view of a modified beam similar to the beam shown in FIG. 11.

FIG. 12 illustrates another Z-shaped purlin or beam 195 which has a roll-formed sheet metal panel having a cross-sectional configuration similar to the cross-sectional configuration of the roll-formed panels forming the beams 135, 155. That is, the beam 195 includes upper and lower flange sections 196 and a web section 198 formed by a flat vertical web portion 199 and oppositely projecting inclined web portions 201 which are connected to the corresponding flange sections 196 by vertical web portions 202. In addition to the longitudinally spaced inside corner stiffening braces or elements 204, the beam 195 has a set of longitudinally extending metal stiffening strips 206 and 208 which are spot or seam welded to one side of the web section 198 at the junctions of the inclined web portions 201 and the vertical web portion 199.

Each of the Z-shaped purlins or beams described in connection with FIGS. 1–12 provides desirable features and advantages. For example, each of the beams provides for signigicantly reducing the weight per foot ratio relative to the weight per foot ratio of a conventional Z-shaped purlin such as shown in above mentioned U.S. Pat. No. 3,225,872 while also providing for equal or greater strength or load carrying ability. Thus, the beams of the invention provide for significantly reducing the cost of a Z-shaped purlin or beam per linear foot of beam and thereby provide for a significant reduction in the cost of constructing a building. Each of the beams of the invention also provide for relatively close nesting of the beams when they are stacked to aid in minimizing the cost for storing and shipping the beams. In addition, the configuration of each beam, including the vertical intermediate web portion and the vertically overlapping flange sections of each beam, provides for reducing the roll-over moment on each beam relative to the roll-over moment on a standard Z-shaped purlin.

The savings arising from the weights per foot indicated, are a result of the inventions' ability to increase the height of the beam or purlin, and consequently its strength, and/or reduce the metal thickness used. Other combinations of web and flange thickness and overall web height could result in savings in excess of those suggested.

While the Z-shaped forms of purlins or beams herein described constitute preferred embodiments of the invention, it is to be understood that the invention is not limited to these precise forms of beams, and that changes may be made therein without departing from the scope and spirit of the invention as defined in the appended claims.

The invention having thus been described, the following is claimed:

1. An elongated beam adapted for use in constructing a building and having a substantially high strength/-weight ratio, said beam comprising a roll-formed sheet metal panel forming a web section integrally connecting upper and lower flange sections, said web section having upper and lower inclined web portions sloping in opposite directions from a generally vertical intermediate web portion integrally connecting said inclined web portions, said web section further including upper and lower generally vertical web portions horizontally offset and integrally connecting the corresponding said inclined web portions to the corresponding said flange sections, said upper and lower flange sections being disposed in vertical overlapping relation and projecting laterally in opposite directions from the corresponding said upper and lower generally vertical web portions for providing said beam with a generally Z-shaped cross-sectional configuration to facilitate stacking a plurality of said beams in interfitting nested relation, and means for stiffening said upper and lower flange sections relative to said web section while providing for stacking a plurality of said beams in said interfitting nested relation during storage and shipping.

2. A beam as defined in claim 1 wherein said stiffening means comprise longitudinally extending sheet metal corner strips secured to one side of said web section where said inclined web portions join said vertical intermediate web portions.

3. A beam as defined in claim 1 wherein said stiffening means comprise a second upper flange section and a second lower flange section separate from the first said upper and lower flange sections, one of said second flange sections disposed inwardly of the corresponding first said flange section in adjacent conforming relation, and the other said second flange section disposed outwardly of the corresponding first said flange section in adjacent conforming relation.

4. A beam as defined in claim 1 wherein one of said inclined web portions and the corresponding said flange section are smaller than the other said inclined web portion and corresponding flange section to provide for interfitting overlapping end portions of two of said beams arranged in longitudinal alignment.

5. A beam as defined in claim 1 wherein each of said flange sections has a longitudinally extending and inwardly projecting intermediate stiffening rib and an inclined edge portion.

6. A beam as defined in claim 1 wherein said stiffening means comprise a set of longitudinally extending sheet metal strips each conforming to one of said flange sections and the adjacent portion of said web section.

7. A beam as defined in claim 6 wherein each metal strip conforms to the adjacent said inclined web portion.

8. A beam as defined in claim 1 wherein said stiffening means comprise longitudinally spaced inside corner stiffening elements extending between each said flange section and the generally vertical portion of said web section.

9. A beam as defined in claim 8 wherein each said stiffening element comprises a molded corner bracket.

10. A beam as defined in claim 8 wherein each said stiffening element comprises an inclined metal bracket.

11. A beam as defined in claim 1 wherein said means for stiffening said flange sections comprise a plurality of longitudinally spaced rigid stiffening members extending from said web section to said upper and lower flange sections and secured to said sections.

12. A beam as defined claim 11 wherein said stiffener members comprise formed metal ribs conforming to said flange sections and said inclined web portions, and means securing said ribs to said flange sections and web portions.

13. A beam as defined claim 12 wherein each said rib has generally a T-shaped cross-sectional configuration.

14. A beam as defined in claim 11 wherein said stiffener members comprise brace members extending from each flange section to said intermediate web portion.

15. A beam as defined in claim 14 wherein each said brace member comprises a formed sheet metal brace, and fastener means securing each said sheet metal brace to said flange and web sections.

16. A beam as defined in claim 14 wherein each said brace member comprises a molded brace having means for receiving fasteners extending through said flange and web sections.

* * * * *